United States Patent [19]

Tournier

[11] 4,381,132

[45] Apr. 26, 1983

[54] FLAT CABLE CONNECTOR

[75] Inventor: Gilles F. A. Tournier, Leguevin, France

[73] Assignee: ITT, New York, N.Y.

[21] Appl. No.: 185,793

[22] Filed: Sep. 10, 1980

[51] Int. Cl.[3] ..... H01R 13/38

[52] U.S. Cl. ..... 339/99 R; 339/17 F; 339/103 M; 339/176 MF

[58] Field of Search ..... 339/97 R, 97 P, 98, 339/99 R, 17 F, 176 MF, 103 R, 103 M

[56] References Cited

U.S. PATENT DOCUMENTS

| | | | |
|---|---|---|---|
| 4,118,096 | 10/1978 | Takahashi | 339/99 R |
| 4,171,857 | 10/1979 | Forberg et al. | 339/97 P |
| 4,256,360 | 3/1981 | Debaight | 339/97 R |
| 4,315,662 | 2/1982 | Greenwood et al. | 339/17 F X |

FOREIGN PATENT DOCUMENTS

| | | | |
|---|---|---|---|
| 2261833 | 6/1974 | Fed. Rep. of Germany | 339/176 MF |
| 2610461 | 9/1977 | Fed. Rep. of Germany | 339/97 R |

*Primary Examiner*—Joseph H. McGlynn

*Attorney, Agent, or Firm*—T. E. Kristofferson; T. L. Peterson

[57] ABSTRACT

A flat cable insulation-displacement connector in which the center-to-center spacing of the terminals is less than the spacing between the conductors of the flat cable. The terminals are inserted in the connector housing so that the planes containing the contact slots present an angle of 23° to the lateral axis of the connector. A cable clamp is provided with guide channels positioning the cable over the contact forks at the same angle of 23°. The clamp is provided with relief contours over which the cable is bent successively along several angles when forced down by closing the cover, thus realigning the cable with the connector axis.

3 Claims, 10 Drawing Figures

Fig.1.
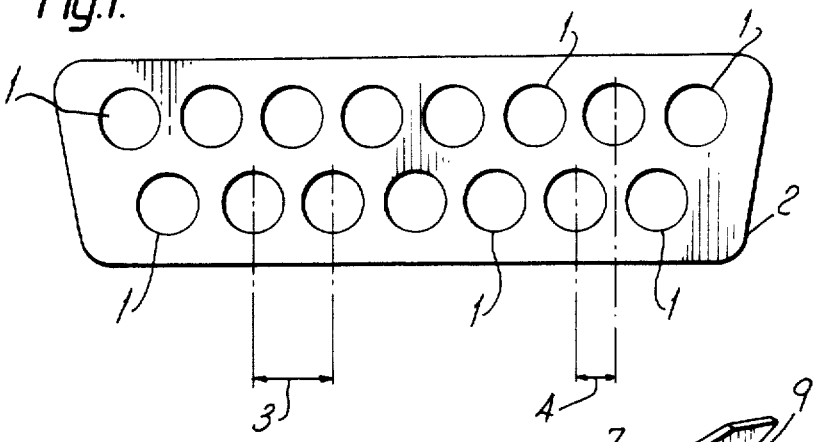
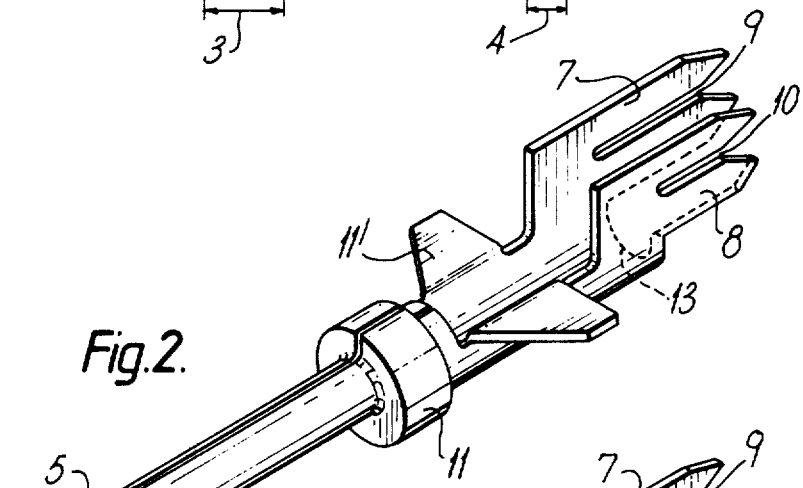
Fig.2.
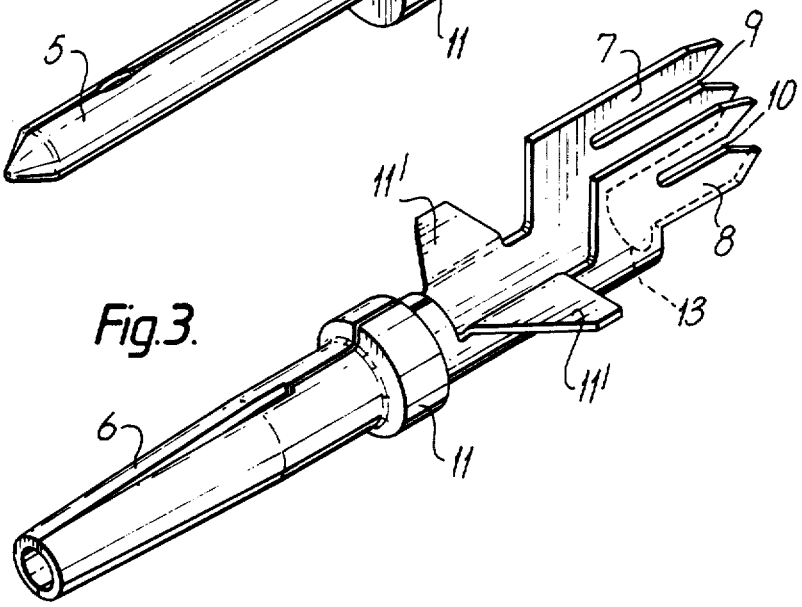
Fig.3.

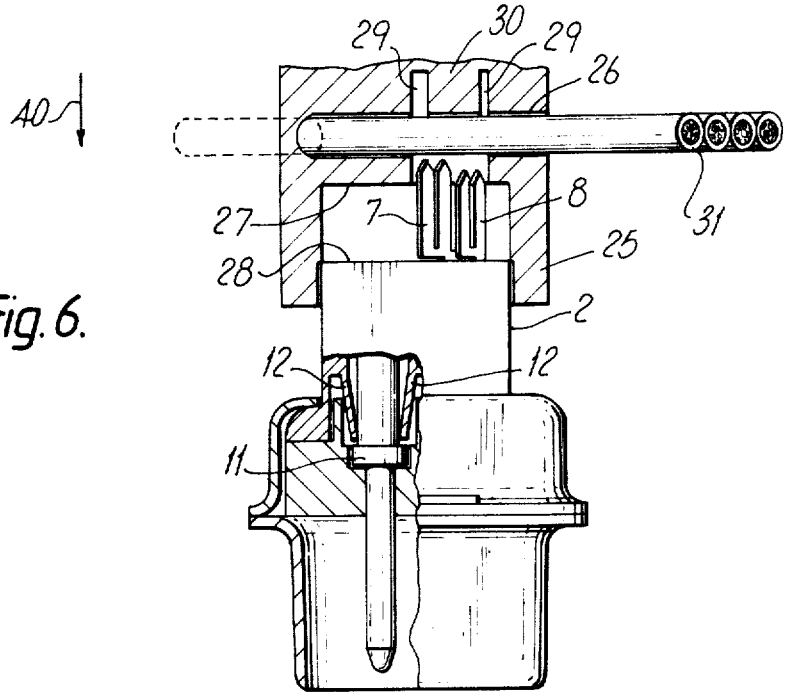
Fig. 6.
Fig. 7.
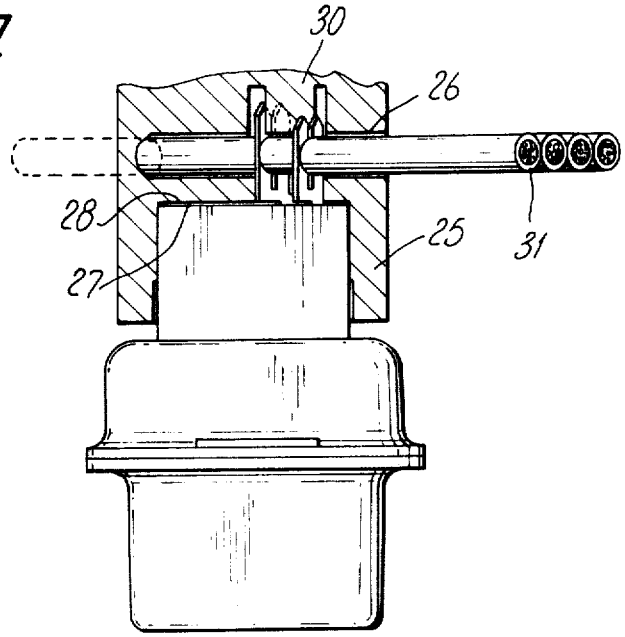

FLAT CABLE CONNECTOR

BACKGROUND OF THE INVENTION

The present invention relates to a flat cable connector and, more particularly, to an insulation-displacement connetor with terminals whose center-to-center spacing is different than the spacing of the conductors in the flat cable to be connected.

Flat cables and insulation-displacement connectors are in common usage in the electronics industry. Such cables come in the form of flat ribbons composed of parallel metal conductors covered in a flexible insulating material and spaced the same as the connector terminal spacing. These terminals often embody two-pronged forks, spaced so that if pressure is applied to the flat cable, each fork pierces the insulating material on both sides of its corresponding conductor as well as the conductor itself which is wedged between the two prongs, (or tines) of the forks, thus assuring the electrical and the mechanical quality of the connection.

This type of interconnection offers many advantages over those obtained by soldering or by wire wrapping, amongst which might be mentioned the reduction obtained in the volume and in the weight of the connection, the flexibility of application, the rapid action and easy handling which contribute to lowering overall costs.

However, in electronics applications the flat cable connections must be effected with very small sized components. The conductor diameter of flat cables in thus about 3/10 of a millimeter with conductor and terminal spacing of 1.27 mm, for example. The spacing dimensions must be kept within a tolerance strict enough to ensure problem-free and reliable interconnections. Hence, special types of connectors are designed for use with flat cables.

Long before flat cables became available, miniaturized connectors already existed, generally rectangular in shape, with a single or double row of terminals, and of a size very close to that of the new flat cable connectors. Proved in the field by usage and possessing certain highly desirable features, these older connectors are still widely used. Moreover, their terminal tails, which were originally designed for soldering or wire wrapping, can be re-designed for "insulation piercing" for use with flat cables. However, a problem is encountered due to the fact that the spacing between terminal center axes of these existing rectangular connectors does not correspond to the spacing of the conductors in flat cables. For example: the center-to-center spacing between contacts of the same row in this type of connector is 2.76 mm and 1.38 mm between alternate contacts in the case of a double row of terminals. Obviously, even in the most favorable arrangement of connecting two adjacent cable conductors to two ordinaly successive terminals along the long axis of the connector, i.e. one in each row, there would remain a gap of 0.1 mm (1.38 mm - 1.27 mm). Considering the cumulative error over the full range of the terminals and conductors, it is evident that the miniaturized rectangular connectors with insulation piercing terminals cannot be used directly for interconnecting the flat cable.

However, the desirability of being able to interconnect these connectors with those having a terminal spacing suitable for flat cables led to the development of special devices for this purpose. Some of these devices, either manually operated, or automatic, cut the insulation between the conductors in the flat cable, and "fan-out" the insulated conductors to match up with the spacing of the terminals in the connector.

Other means employed to the same end consist of providing intermediate, mechanical type adapters. These devices are costly, often complicated in nature, and in all cases contrary to the primary purpose of flat cable usage, which is the possibility of a rapid and single movement interconnection of the whole set of cable conductors.

The purpose of this invention is to eliminate the disadvantages cited, simply and economically, by a means which is limited solely to slanting the flat cable at an appropriate angle when presenting it to the insulation piercing terminals of the connector, and adopting a certain geometric arrangement of the insulation piercing terminals, and to providing a cable clamp, having a cover so designed as to correct the deviation from its normal axis which is imposed upon the flat cable by the connector, and to realign the segment of the cable issuing from the connector to the normal axis of the cable.

SUMMARY OF THE INVENTION

According to the invention, there is provided a miniaturized rectangular connector with a double row of insulation piercing terminals so disposed that the prongs of the terminals with the cutting edges which serve to slice through the insulation and to establish contact with the conductors of the flat cable are offset laterally with regard to the center axes of the terminal and their corresponding contact cavities in the connector housing.

For simplicity, in the description and claims which follow, the plane of symmetry containing the axis of the central contact cavity of the housing, and orthogonal to the two planes containing the axes of each row of cavities, will be referred to as the "lateral plane" of the connector, and the insulation displacement forks of the terminals will be said to be "facing" in that direction toward which they are offset. Further, the "axis" of a fork will be understood as that axis which would coincide with the axis of a cylindrical flat cable conductor lodged between the two double tines or prongs of a fork. The fork offset is used to define that the forks of the terminals of one row all face in the same direction with those of the opposite row facing in the opposite direction but with the axes of the forks in both rows parallel to each other and forming a certain angle with the lateral plane of the connector housing, 23° in this particular instance. This arrangement allows the use of these connectors, widely reputed for their reliability, for connecting flat cables even though their average spacing between terminal cavity centers is 2.76 mm, whereas the spacing between the conductors in a flat cable is generally 1.27 mm. In effect, to use such a connector with a flat cable, it suffices to present the flat cable at a slant of 23° to the connector's lateral axis and all of its conductors will then be aligned along the axes of the terminal forks belonging alternatively to one and to the other row of terminals.

However, while this arrangement offers a solution to the alignment of flat cable conductors with the terminals of certain types of widely used connectors, it leaves intact the problem of the deviation imposed upon the cable by slanting it for alignment with the connector terminals. The cable leaving the connector would, in effect, be slanted out of line with the connector's lateral axis which would constitute a drawback in certain applications. To remedy this, the invention provides a cable clamp with a hinged cover. The clamp is traversed by guide channels serving to position the individual conductors with respect to their terminals before the actual connection is effected. The cable clamp is also provided with a particular profile designed to shape the cable along such planes so as to redress its position, and to bring it back into line. The clamp cover presents a complementary configuration designed to secure the flat cable after folding, and thus protect the contacts from subjection to mechanical stresses originating outside of the connector.

BRIEF DESCRIPTION OF THE DRAWINGS

FIG. 1 is a simplified rear end view of a miniaturized rectangular connector of a well known type, with two rows of cavities for lodging terminals;

FIGS. 2 and 3 are large scale perspective views of a male (pin) and of a female (socket) terminals of an insulation displacement connection type used by the invention;

FIG. 6 is a partial cutout and transverse sectional view of the connector and cable clamp showing the parts used to connect a flat cable in position prior to the actual connection;

FIG. 7 is similar to FIG. 6 but shows the connector and clamp position with the cable conductors connected to the terminals;

DESCRIPTION OF THE PREFERRED EMBODIMENT

Figure 4:
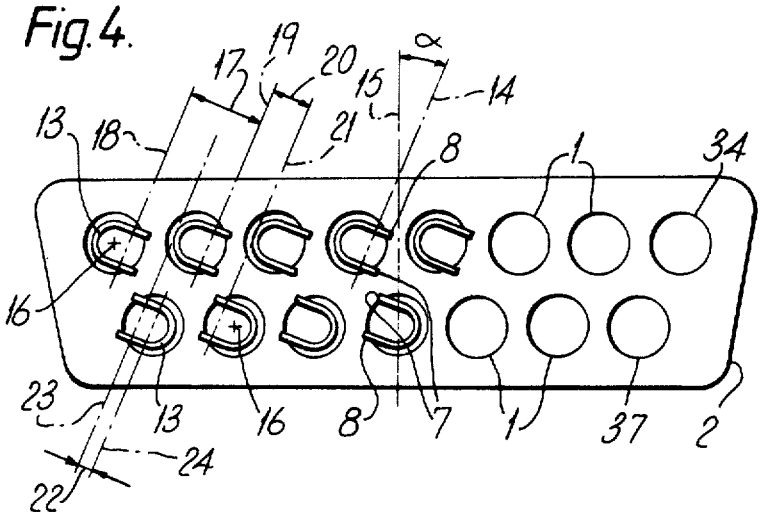
FIG. 4 is a rear end view similar to FIG. 1 showing a few terminals in place in the cavities of the connector, with only the connecting fork ends showing.

Referring now to FIG. 1 in detail, there is shown a simplified end view of a well-known type of miniaturized rectangular connector and, in particular, the contact or terminal cavities 1 in the insulating housing body 2 of the connector. As can be seen, these cavities are arranged in two rows. The center-to-center distance between two adjacent cavities in the same row is typically 2.76 mm while the center-to-center distance between cavities of alternate rows is half of the latter, or 1.38 mm. Modification of the cavity locations in the housing to reduce their center spacing to 2.54 mm and 1.27 mm, corresponding to the conductor spacing of flat cable, is excluded for economic reasons and customer requirements. The invention permits the use of the insulating housing body 2, shown in FIG. 1, as is, but with the insulation piercing terminals so designed that when inserted into the terminal cavities, their effective spacing will correspond with that of the flat cable conductors.

The connection terminals are illustrated in FIGS. 2 and 3, the one in FIG. 2 representing a pin (male) terminal 5, and the one in FIG. 3 a mating socket (female) terminal 6. It goes without saying that only terminals of the same nature, pins 5 or sockets 6, are mounted in the same housing 2. It should be noted, however, that the insulation piercing ends of the terminals in both figures are identical in shape. Each one comprises two similar parallel forks 7, 8 each consisting of two prongs or tines with the slots 9 or 10 between. The tines perform the insulation stripping and wedging of the conductor of the flat cable between them to establish electrical contact by a well-known method which will not be described here. The shoulder 11 on the terminal retains the terminal in its cavity 1 (FIG. 1) in conjunction with the metal retention chip shown in FIG. 6, also well known in the art. The terminal has two diametrically opposed lateral fins 11' which embed in the wall of the cavity 1 to block any rotational movement after insertion in a certain specific position which will be described later. The semi-circular land formed by the edge 13 is at the same level as the bottom of the slots 9 and 10 so that when a cable conductor is wedged into the slots the adjacent section of the flat cable rests upon this ledge 13, as can be seen more clearly in FIG. 4. The slots 9 and 10 do not lie in the center axis of the pin (or socket) but are offset thereto for reasons that will now be explained.

FIG. 4 shows the connector housing 2 with some but not all terminals in place in their cavities with only their connecting fork ends showing. The terminal emplacement must meet two rules: the terminals must all be inserted into the cavities so that the axis 14 of each double fork (as previously defined herein), passing through the slots 9 and 10 of each tine pair 7 and 8 forms a certain angle, which is 23° in this particular instance, with the lateral plane 15 of the connector housing (also defined hereinbefore); and furthermore, all of the terminal tines 7 and 8 in the same row must be offset laterally to the same side of their pin or socket center axis 16, for example, to the right of the axis 16 in the top row and to the left in the bottom row.

The distance between centers of the cavities 1 being the distance 3 in FIG. 1, the aforementioned centers being coincident with the axes 16, and equal to 2.76 mm, it follows that the distance between fork axes 18 and 19 (previously defined) will be equal to 2.76 mm multiplied by the cosine of 23°, or 2.54 mm. The same applies to the distance 20, representing the distance between the fork axes 19 and 21 of two terminals not in the same row since this distance is the product of the center distance (FIG. 1) of 1.38 mm by the cosine 23°, which gives the distance 20 equal to 1.27 mm. Thus, it becomes apparent that the application of the two rules given above allows the alignment of the stripper-connector slots to the spacing of the conductors in flat cables in common current usage while maintaining the same type of terminal for use in either row of the housing cavities. It was noted, in effect, in the explanation above of FIGS. 2 and 3 that the insulation piercing contact slots 9 and 10 were contained in a plane parallel to, but not including, the longitudinal axis of the terminal pin (or socket), i.e., offset from that axis. This offset is represented in FIG. 4 by the distance 22 between the fork axis 23 and the pin (or socket) center axis of any single terminal. This offset 22 leaves the area over the semi-circular edge 13 clear for the passage of the conductor next to the one connected by the terminal (see also FIGS. 2 and 3). Thus, the configuration of the terminals not only allows the positioning of each conductor over its proper insulation piercing forks but also assures that it can never make contact with any of the other adjacent terminals.

To position the cable so that its conductors will be in line with the axes 18, 19, 21 and 23, and the others not illustrated, requires that the cable be presented at an angle of 23° to the connector. To this end the cable clamp 25, shown in FIGS. 5, 6, 7, 8 and 9, is traversed by guide channels 26 of a diameter admitting the passage of the insulated conductors in the flat cable and having the same spacing. Thus, the end of the cable can be easily introduced into these guide channels 26 and then passed through to the desired length when several connectors are to be mounted, or left with its end inserted short of the channel aperture to protect against accidental shorting. These channels in the insulated body of the cable clamp run at an angle of 23° to the axis of the connector. It can now be seen that after introduction into the guide channels 26 the flat cable conductors are positioned in the planes of the fork slot axes of the terminals and ready to be connected. This state is illustrated in FIG. 6 which is a side view in cross-section of the connector-cable-clamp assembly along the axis of a guide channel 26 over the stripper forks 7 and 8 of a terminal. This cross-sectional view of the cable clamp 25 shows the internal configuration that shall be considered in relation to FIG. 5. The bottom of the recess 27 forms an abutment for the rear surface 28 of the connector. Blind holes 29 are provided to accommodate and to guide the fork tines 7 and 8 when the cable clamp is forced down upon the connector and assumes its final position (FIG. 7) upon completion of the connection. It will be noticed that the two holes 29, corresponding to the two tines of the same connecting fork, form a pad 30 therebetween designed to press down upon the cable conductor insulation 31 between the two tines 7 and 8.

Figure 5:
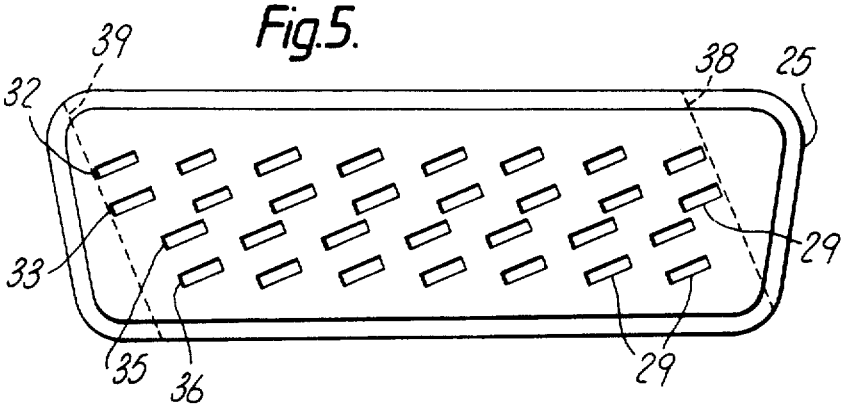
FIG. 5 is a view of the interior of the cable clamp which inserts the conductors of the flat cable between the prongs or tines of the terminal forks, showing the recesses provided to accommodate the terminal forks.

For the sake of clarity it should also be noted that FIG. 5 shows an inverted view of the cable clamp, i.e., in the "connected" position of FIG. 6, the holes 32 and 33 would mate with the tines (not shown in the drawing) of the terminal housed in the cavity 34 of FIG. 4 and the holes 35 and 36 with the tines (not shown) of the terminal in the cavity 37. The inversion also explains the symmetrical disposition of the dotted lines 38 and 39, representing the edges of the flat cable, in relation to the axes 14, 18, etc., of FIG. 4.

In view of the foregoing, and referring back to FIG. 6, it can be seen that the operation of effecting the connection consists in applying sufficient pressure upon the cable clamp 25 in the direction of arrow 40 to simultaneously pierce the insulation surrounding each conductor of the cable and to establish metal-to-metal contact between each conductor and its corresponding set of forks 7 and 8. The situation upon completion of this operation is illustrated in FIG. 7, showing the rear surface 28 of the connector abutting against the surface 27.

Figure 8:
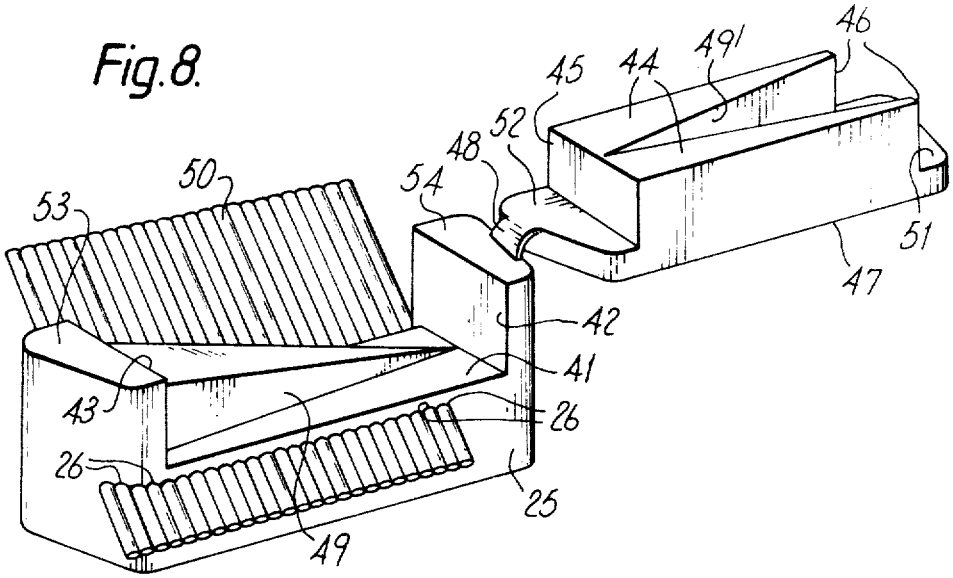
FIG. 8 is a perspective view of the cable clamp and its cover as proposed by the invention together with a flat cable partially in place.

The cable 50 is shown in FIG. 8, at an angle to the longitudinal axis of the connector housing. It can be seen that the cable clamp 25 has a cutout section bounded by the bottom surface 41 and by two walls 42 and 43 designed to mate with the surfaces 44, 45 and 46, respectively, of its cover 47, which is attached to the clamp by a flexible hinge 48. There is a raised "pyramid style" ramp 49 in the cutout with a matching cavity 49' provided in the cover 47. The purpose of the three identical sides of the pyramidal ramp is to force the folding of the flat cable in such a manner as to eliminate its slant and to realign it with the axis of the connector. The cable 50 is, effectively, folded back manually between the walls 42 and 43 and the cover 47 is closed down until the surfaces 51 and 52 abut against the surfaces 53 and 54 of the cable clamp.

Figure 10:
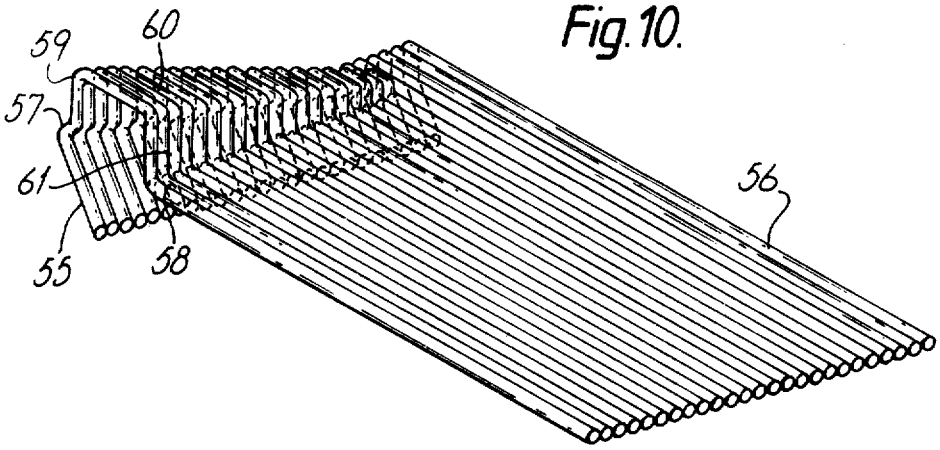
FIG. 10 is a perspective view of the flat cable configuration after the bending imposed upon it by the cable clamp and its cover.
Figure 9:
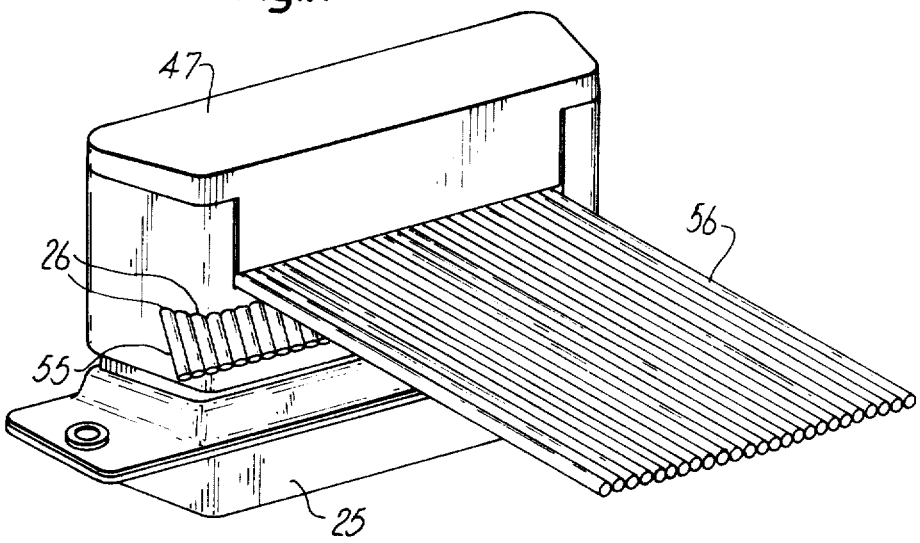
FIG. 9 is a perspective view similar to FIG. 8 with the cover of the clamp depressed over the flat cable.

The cover in its "closed" position is shown in FIG. 9 where the lower part 55 of the flat cable 5 can be clearly seen as being at an angle to the axis of the connector while the upper part 56, wedged in by the cover, is in line with the axis. This "straightening out" of the flat cable is the result of the folding imposed upon it when it is forced down over the pyramid style ramp 49 (FIG. 8) by the mating cavity in the cover 47 when the cover is closed down over the cable clamp 25. For the sake of clarity, FIG. 10 shows a view in perspective of the section of a cable subjected to the folding process after withdrawal from the cable clamp. The sections 55 and 56 shown in FIG. 9 are clearly seen in FIG. 10 and the areas 57 and 58 which were pressed down against the base surface 41 (FIG. 8) by the cover are clearly seen, as well as the zones 59, 60 and 61 wedged by the cover against the three sides of the ramp 49 which have retained the shape thus imposed.

It should be understood that the foregoing description is made for the sake of example and is in no way restrictive since other variations are conceivable within the scope of the invention.

What is claimed is:

1. A flat cable connector comprising:

a connector housing containing a row of contact cavities, each cavity receiving a terminal having an insulation piercing fork;

the center-to-center spacing of said terminals differing from the spacing of the conductors of the flat cable to be connected;

the plane of the slot (14) between the tines of the fork of each terminal being offset from the center axis (16) of said terminal and from the coincident central axis of its corresponding contact cavity;

all of the forks of the terminals in said row of cavities being offset to the same side of the said coincident central axes;

said forks being oriented so that the planes passing through the slots between the tines of said forks are disposed at a predetermined angle ($\alpha$) with respect to the lateral plane (15) passing through the vertical axis of the connector housing;

said angle being such that conductors of the flat cable to be connected will be aligned with the slots between said tines of the forks of said terminals when the cable is disposed at said angle with respect to the connector;

a cable clamp for effecting simultaneously the insulation piercing and the connection of all of the conductors of the cable, said clamp having a cover for relieving the connections from stresses due to pulling exercised on the cable;

said cable clamp being traversed by guide channels corresponding in number, diameter and spacing to the conductors of the flat cable;

said guide channels being parallel to each other and situated in a plane perpendicular to the cutting edges of said fork tines;

the longitudinal axes of said guide channels extending at an angle with respect to said lateral plane of said connector housing the same as said predetermined angle, whereby the flat cable will exit from the housing at a slant;

the side of said cable clamp opposite to said connector housing having a roughly "U"-shaped cutout of a width corresponding to the width of the flat cable to be connected; and a pyramid type ramp in said cutout having a base merging with one side of said cutout with its apex extending to the opposite side of said cutout.

2. A flat cable connector as set forth in claim 1 wherein:

said pyramid type ramp embodies surface means for abutting against the flat cable and correcting the slant of the flat cable issuing from said guide channels to realign the cable so that its longitudinal axis coincides with the axis of the connector housing.

3. A flat cable connector as set forth in claim 2 wherein:

said cover has a cavity matching the contour of said pyramid type ramp, so that upon closing the cover on the cable clamp, the cable will be forced down over the ramp and bent, or folded over said surface means on the ramp.

* * * * *